US005454503A

United States Patent [19]

Udagawa et al.

[11] Patent Number: 5,454,503

[45] Date of Patent: Oct. 3, 1995

[54] ELECTRIC STAPLER

[75] Inventors: Hiroshi Udagawa; Toru Yoshie, both of Tokyo, Japan

[73] Assignee: Max Co., Ltd., Tokyo, Japan

[21] Appl. No.: 285,713

[22] Filed: Aug. 4, 1994

[30] Foreign Application Priority Data

Aug. 4, 1993 [JP] Japan ..... 5-046634 U

[51] Int. Cl.[6] ..... B27F 7/21

[52] U.S. Cl. ..... 227/82; 227/120; 227/136

[58] Field of Search ..... 227/7, 82, 120, 227/131, 132, 135, 136

[56] References Cited

U.S. PATENT DOCUMENTS

| | | | |
|---|---|---|---|
| 4,570,841 | 2/1986 | Olesen | 227/95 |
| 4,588,121 | 5/1986 | Olesen | 227/120 |
| 4,623,082 | 11/1986 | Kurosawa | 227/7 |
| 5,269,451 | 12/1993 | Udagawa et al. | 227/120 |
| 5,273,199 | 12/1993 | Logtens | 227/120 |
| 5,346,114 | 9/1994 | Udagawa et al. | 227/120 |

FOREIGN PATENT DOCUMENTS

| | | |
|---|---|---|
| 0446055 | 9/1991 | European Pat. Off. . |
| 0475436 | 3/1992 | European Pat. Off. . |
| 1028083 | 4/1958 | Germany . |
| 454683 | 5/1992 | Japan . |
| 9320977 | 10/1993 | WIPO . |

*Primary Examiner*—Rinaldi I. Rada
*Assistant Examiner*—Jay A. Stelacone
*Attorney, Agent, or Firm*—Cushman Darby & Cushman

[57] ABSTRACT

An electric stapler comprises a cartridge and an electric stapler main body on which the cartridge is detachably mounted. The cartridge integrally including: an accommodating section for accommodating a plurality of staple sheets in multi-layered form, each of the staple sheets being formed by sticking straight staples together in sheet-like form; a staple passage extending from a lower end of the accommodating section; a pusher for pushing legs of a staple forward, the staple being formed into a square U-shape at a front end of the staple passage; and a drive channel, arranged at the front of the staple passage, for receiving the formed staple pushed by the pusher. And the electric stapler main body including: an attaching section for attaching the cartridge thereto; a staple feeder for feeding the staple sheets from within the cartridge toward the staple passage; a forming and driving device for sequentially forming a staple of the fed staple sheet from the front end of the staple sheet into a square U-shape and driving the formed staple out; and a clincher section for clinching the legs of the driven staple.

2 Claims, 7 Drawing Sheets

ELECTRIC STAPLER

BACKGROUND OF THE INVENTION

The device relates to an electric stapler and a cartridge detachably mounted thereon.

As shown in, e.g., Japanese Unexamined Utility Model Publication No. Hei. 4-54683, a conventional electric stapler is of such a structure as to releasably attach a cartridge to an electric stapler main body, the cartridge accommodating a plurality of staple sheets in multi-layered form and having a pressing spring for pressing the accommodated staple sheets downward from the top. The main body includes: a mechanism for sequentially feeding the staple sheets within the cartridge attached to the main body from the bottommost one; a forming means for forming a staple in the front end of the fed staple sheet into a square U-shape; and a driving means for driving the formed staple toward a material to be stapled. Such an electric stapler is, in most cases, incorporated into an apparatus such as a copying machine.

By the way, the stapler is designed so that a jammed staple can be removed by opening the staple driving section when a staple driven out by the driving means is jammed inside the stapler during the stapling operation. However, in the case where the electric stapler is attached to a copying machine or the like, not only the operation of opening the staple driving section is extremely cumbersome because the space within the copying machine or the like in which the electric stapler is disposed is small, but also it is difficult to visibly locate the jammed staple with the driving means and the forming means standing in the way of the staple passage because the driving and forming means are disposed around the staple passage. Accordingly, the operation of removing jammed staples within the apparatus is extremely burdensome.

SUMMARY OF THE INVENTION

The device has been made in view of the above problems. Accordingly, the object of the device is to provide an electric stapler whose structure is such that a cartridge having a staple sheet accommodating section and a staple passage is releasably attached to an electric stapler main body so that the operation of removing a jammed staple can be performed with ease by releasing the cartridge from the electric stapler main body.

To achieve the above object, the device is applied to an electric stapler comprising a cartridge and an electric stapler main body to which the cartridge is releasably attached. The cartridge integrally includes: an accommodating section for accommodating a plurality of staple sheets in multi-layered form, each of the staple sheets being formed by sticking straight staples together in sheet-like form; a staple passage being formed so as to extend from from a lower end of the accommodating section; a pusher for pushing legs of a staple forward, the staple being formed into a square U-shape at a front end of the staple passage; and a drive channel, arranged at the front of the staple passage, for receiving the formed staple pushed by the pusher. The electric stapler main body includes: a section for attaching the cartridge thereto; a staple feeder extending into the cartridge for feeding the staple sheets from within the cartridge toward the staple passage; a forming and driving device for sequentially forming a staple of the fed staple sheet from the front end of the staple sheet into a square U-shape and driving the formed staple out; and a clincher section for clinching the legs of the driven staple.

According to the above construction, when the electric stapler is operated with the cartridge being attached to the electric stapler main body, a staple sheet within the cartridge is fed outside the cartridge by the staple feeder via the staple passage, and the fed staple sheet has a staple in the front end thereof sequentially formed into a square U-shape and the formed staple is pushed by the pusher to the drive section to be driven out therefrom, and the legs of the driven staple are clinched by the clincher for stapling a material.

As described above, the electric stapler is of such a construction that a unitized cartridge is releasably attached to the electric stapler main body. Therefore, the operation of removing a jammed staple can be performed only by releasing the cartridge from the electric stapler main body. Hence, even if the electric stapler is attached to an apparatus such as a copying machine, the jammed staple removing operation can be performed extremely easily.

DETAILED DESCRIPTION OF THE PREFERRED EMBODIMENTS

Figure 1:
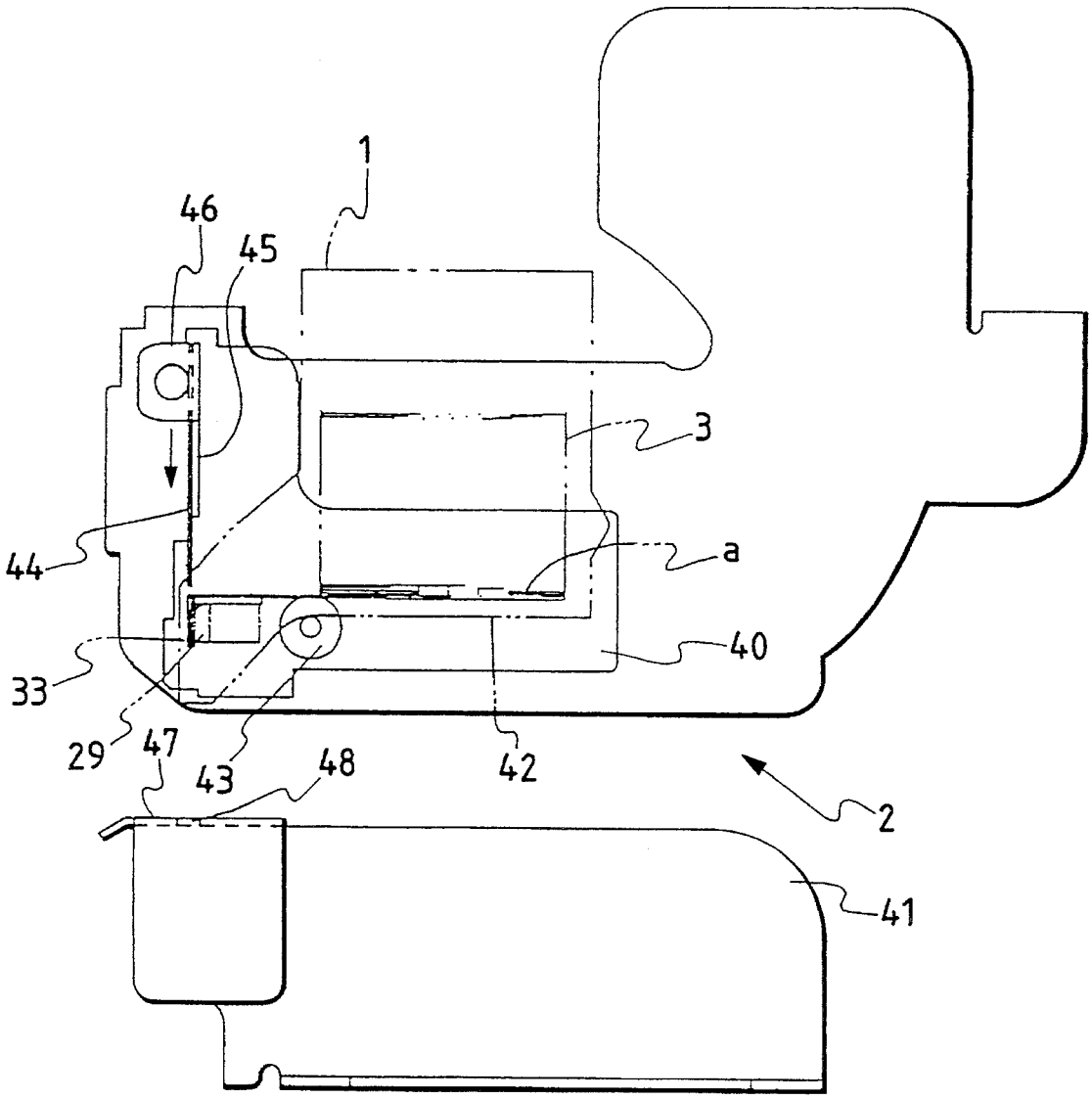
FIG. 1 is a diagram for schematically explaining an electric stapler of the device.

FIG. 1 is a diagram showing the main portion of an electric stapler. The electric stapler includes a unitized cartridge 1 and an electric stapler main body 2.

Figure 2:
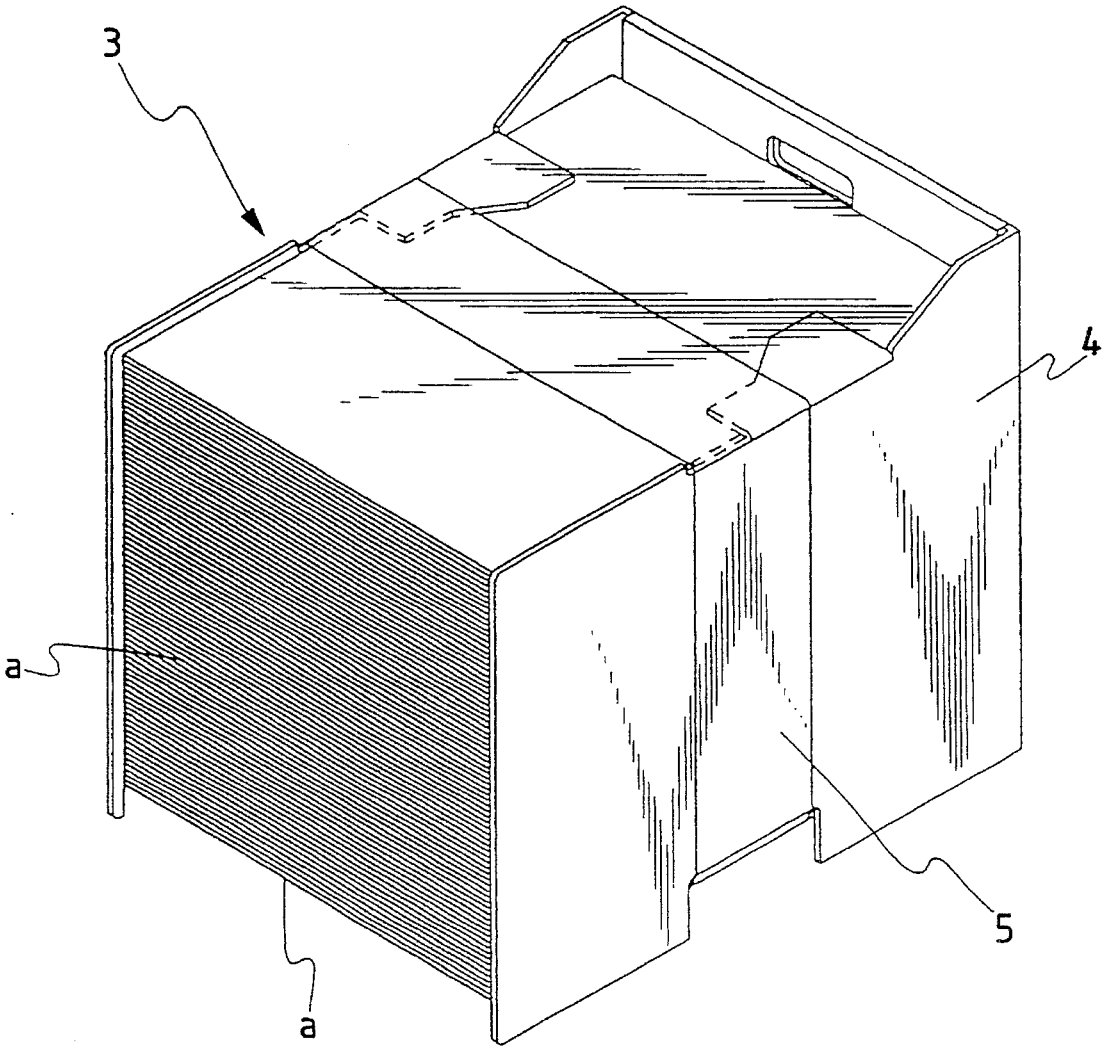
FIG. 2 is a perspective view of an inner cartridge.
Figure 3A:
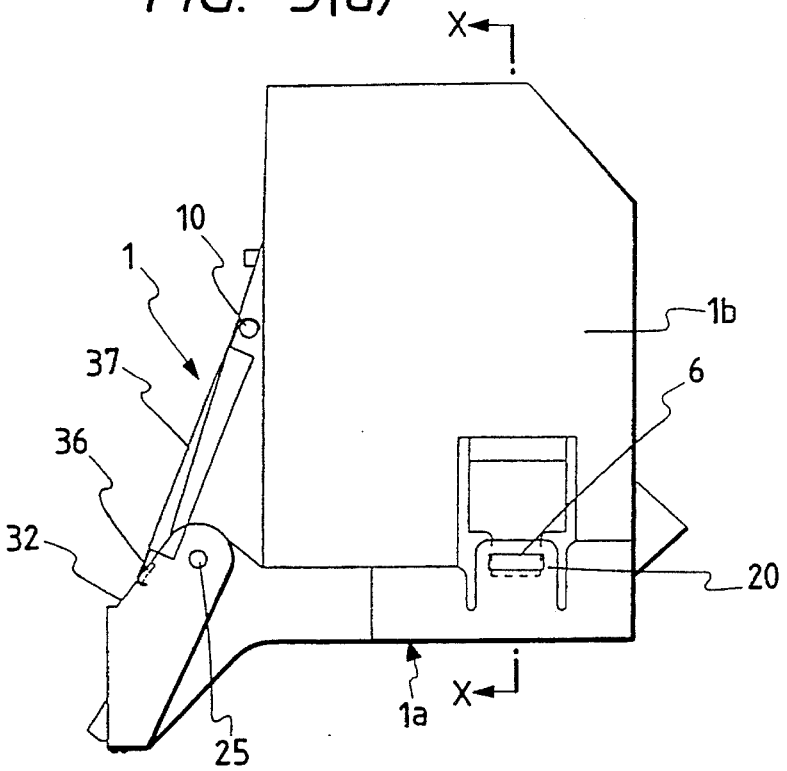
FIGS. 3(*a*) and 3(*b*) are a side view of a cartridge of the device and a front view of a part thereof in section, respectively.
Figure 3B:
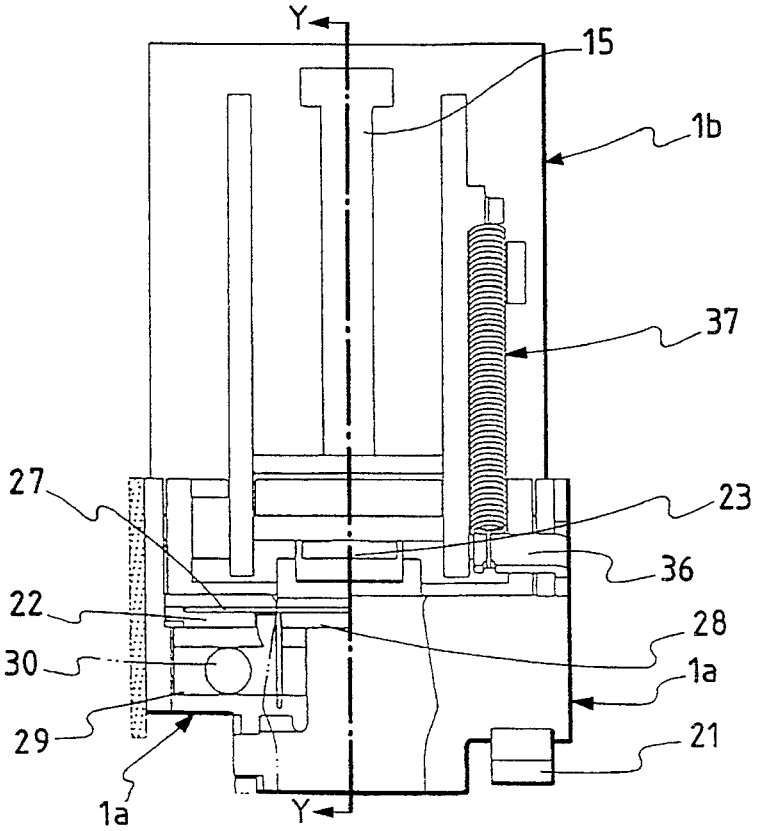

The cartridge 1 has such a structure as not only to accommodate a staple sheet case 3, but also to perform the functions of sequentially feeding staple sheets to a predetermined position from the bottommost staple sheet, forming a staple in the front end of the staple sheet into a square U-shape, and driving the thus formed staple out. As shown in FIG. 2, the staple sheet case 3 is prepared by enclosing the sides of a plurality of staple sheets "a" with a U-shaped cardboard 4 and winding a binding band 5 made of paper around the staple sheets "a". The staple sheets "a" are formed by sticking a plurality of straight staples together in sheet-like form.

As shown in FIGS. 2 to 6, the cartridge 1 is constructed so that an accommodating body 1*b* for accommodating the staple sheet case 3 is arranged so as to be opened and closed with respect to a cartridge main body 1*a*. The accommodating body 1*b* has a space for accommodating most of the staple sheet case 3. The top of the accommodating body 1*b* is closed and the bottom thereof is open. On both side walls 7 of the accommodating body 1*b* are retaining pawls 6, and on a front wall 8 thereof are a pair of triangular projecting walls 9. On top of one of the triangular projecting walls 9 is a spring engaging shaft 10, and on both outer sides of the bottom thereof are bearing sections 11. Inside the accommodating body 1*b* are a pressing spring 12 and a spring holder 13. The pressing spring 12 not only presses the staple sheets "a" within the staple sheet case 3, but also presses the cartridge 1 downward. On the front of the spring holder 13 is an engaging projection 14, which is slidable up and down along a long groove 15 formed in the middle of the front wall of the accommodating body 1*b*.

Figure 6:
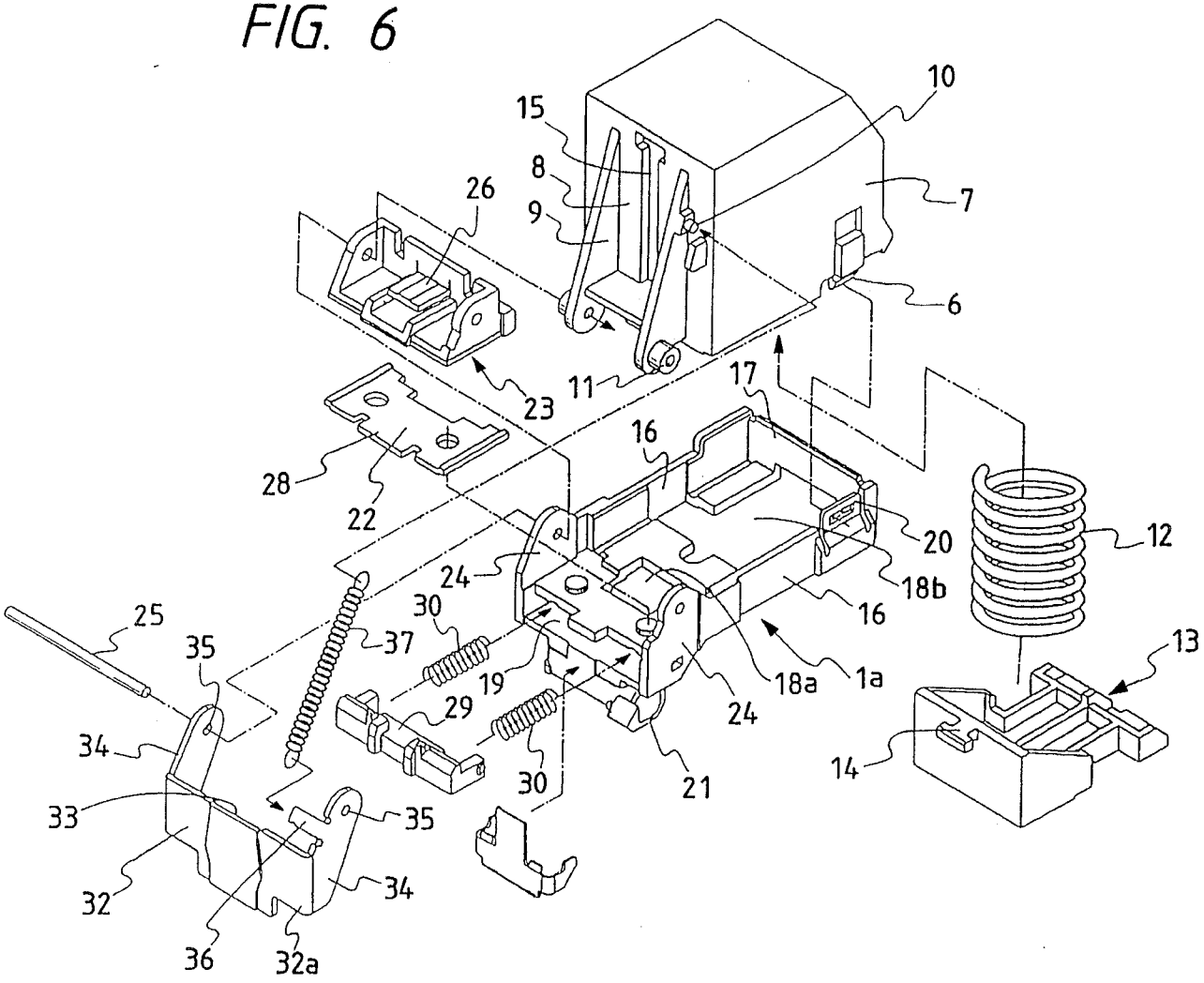
FIG. 6 is an exploded perspective view of an outer cartridge.
Figure 7:
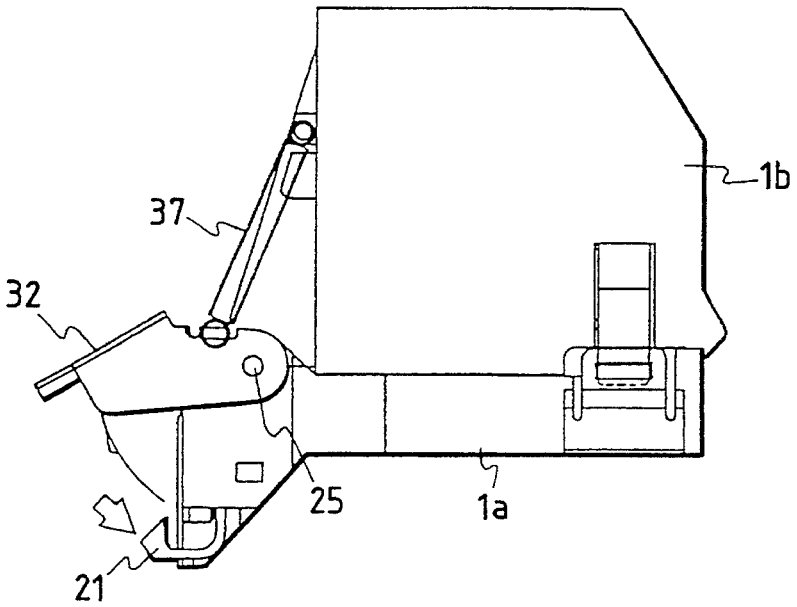
FIG. 7 is a diagram for explaining how a jammed staple is removed.

As particularly shown in FIG. 6, the cartridge main body 1*a* is formed into such a frame that the front and top thereof are open with only both side walls 16 and the rear wall 17, and the bottom thereof has openings 18*a*, 18*b*. The rear half of the cartridge main body 1*a* is formed so as to receive the bottom of the accommodating body 1*b*. A pusher accommodating section 19 that is open frontward is formed at the lower stage of the bottom surface in the front of the cartridge main body 1*a*. Engaging pieces 20 are formed on the rear of side walls 16, and an L-shaped engaging piece 21 is formed in the lower front.

On the upper surface of the upper stage in the front of the cartridge main body 1*a* are a staple guide 22 and a guide hold 23, which are arranged so as to overlap one upon another. The guide hold 23 is secured by a shaft member 25 that passes through erected portions 24 on both sides in the front of the cartridge main body 1*a*. The shaft member 25 is engaged with the upper surface of a spring piece 26 formed on the upper portion of the guide hold 23.

Figure 5:
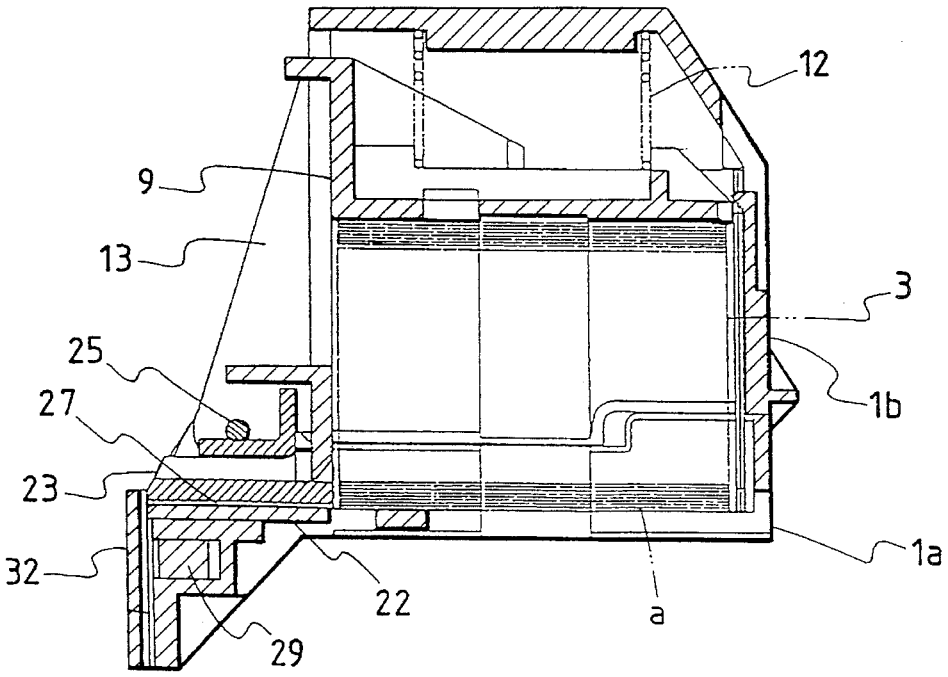
FIG. 5 is a sectional view taken along a line Y—Y of FIG. 3(*b*)

Between the staple guide 22 and the guide hold 23 is a staple passage 27 (see FIG. 5). The staple passage 27 is open both frontward and backward. In the middle of the front of the guide hold 23 is a guide slope. Below such guide slope projects frontward a staple receiving stand 28 that is formed in the middle of the front end of the staple guide 22. The top surface of the bottom of the cartridge main body 1*a* is flush with the top of the staple guide 22 that constitutes the staple passage 27.

As shown in FIG. 6, within the pusher accommodating section 19 of the cartridge main body 1*a* is a pusher 29. The pusher 29 rests upon the lower surface of the accommodating section 19 and is slidable thereon. The pusher 29 is retained within the accommodating section by the face plate 32 and is accommodated therein so as to be slidable forwardly and backwardly, and is urged by springs 30 frontward.

Then, a face plate 32 is disposed in front of the staple passage 27 and the pusher 29. On the back of the face plate 32 is a recessed drive channel 33 which effects a passage for driving out a formed staple, which will be described later. The drive section 33 extends vertically. A lower portion 32*a* is arranged on one side of the face plate 32 so that the L-shaped engaging piece 21 of the cartridge main body 1*a* can be engaged therewith. From both sides of the face plate 32 project side pieces 34 rearward. The face plate 32 is pivotably attached to the cartridge main body 1*a* by causing the shaft member 25 to pass through shaft holes 35 of the side pieces 34. With the face plate 32 attached to the cartridge main body 1*a*, the drive channel 33 faces the front of the staple passage 27.

The cartridge main body 1*a* is pivotably coupled to the accommodating body 1*b* by the shaft member 25 that support the face plate 32 and the guide hold 23. That is, the shaft member 25 passes through the erected portions 24 on both sides in the front of the cartridge main body 1*a* and the bearing sections 11 of the projecting walls 9 in the front of the accommodating body 1*b*. A tension spring 37 is engaged with both the spring engaging shaft 10 on the projecting wall 9 of the accommodating body 1*b* and an engaging projection 36 formed on the side piece 34 of the face plate 32.

As described above, the cartridge 1 is formed by coupling the cartridge main body 1*a* to the staple sheet case accommodating body 1*b*, and can be opened and closed by turning the cartridge main body 1*a* relative to the accommodating body 1*b* about the shaft member 25. To close the cartridge 1, the retaining pawls 6 in the rear of the side walls of the accommodating body 1*b* are engaged with the engaging pieces 20 in the rear of the side walls of the cartridge main body 1*a*. Accordingly, the accommodating body 1*b* and the cartridge main body 1*a* are integrated with each other and, as shown in FIG. 5, form an accommodating section for accommodating the entire part of the staple sheet case 3 in the inside thereof. A staple sheet discharge opening is formed at the lower end of the front side wall of such accommodating section, and such opening is connected to the staple passage 27 from the front thereof.

As shown in FIG. 1, the electric stapler main body 2 has a magazine section 40 and a base stand 41. The magazine section 40 includes: a cartridge 1 attaching section 42; a staple feed roller 43 which extends through opening 18*a* in the bottom of the main body 1*a* into contacting engagement with the bottommost staple sheet for feeding the staple sheets "a" from within the cartridge 1 forward; a holder 46 that holds both a driver plate 44 and a forming plate 45 (whose lower end is formed into a recess that faces down) so as to overlap one upon another. The driver plate 44 and the forming plate 45 serve to form a square U-shaped staple from the front end of the fed staple sheet "a" and drive the formed staple out, and are connected to not shown drive mechanisms, respectively. On the top in the front of the base stand 41 are a stapling stand 47 and a clincher section 48 for clinching the legs of a staple. The staple feeder formed of the feed roller 43 and the drive mechanism thereof as well as the forming and driving device formed of the driver plate 44, the forming plate 45, and the drive mechanisms thereof may be known means and, therefore, they are not limited to those mentioned above.

By the way, when the cartridge 1 is attached to the attaching section 42 of the electric stapler main body 2, the staple feed roller 43 enters slightly into the staple sheet accommodating section from the opening 18*a* (see FIG. 6) on the bottom of the cartridge 1, so that the staple feed roller 43 is engaged with the lower surface of the bottommost staple sheet "a" within the accommodating section. At the same time, the driver plate 44 and the forming plate 45 are disposed above the drive channel 33 on the back of the face plate 32 and the staple receiving stand 28 on the front end of the staple passage 27, respectively.

The operation of the thus constructed electric stapler will now be outlined with reference to FIG. 1. When the staple feeder is driven with the cartridge 1 attached to the attaching section 42 of the electric stapler main body 2, the staple feed roller 43 starts rotating. The bottommost staple sheet "a" within the accommodating section is discharged by the frictional resistance thereof with the staple feed roller 43, so that the staple on the front end of the staple sheet "a" is abutted against the back of the face plate 32 (excluding the drive channel 33) along the staple passage 27, and fed forwardly to a position above the staple receiving stand 28. Then, by operating the forming and driving device, the driver plate 44 and the forming plate 45 are driven downward. The driving device initially makes a blank drive because no staple is supplied at the drive channel 33 of the face plate 32. Since the staple on the front end of the staple sheet "a" has been supplied below the forming plate 45, the forming plate 45 starts forming the staple into a square U-shape by clinching both sides of the staple protruding from the staple receiving stand 28 downward thus forming the legs of the staple. The legs of the staple are pushed downward by the forming plate 45 and contact the top beveled portion at the front of the pusher 29 to cause the pusher 29 to move backward against the force of the springs 30. However, since the width of the formed staple becomes substantially equal to the width of the drive channel 33 of the face plate 32, the formed staple is guided to the drive section 33 by the pusher 29 through the operation of the driver plate 44. When the driving mechanism is activated, the driver plate 44 drives out the formed staple at the drive channel 33 downward and, simultaneously therewith, the forming plate 45 forms the next staple into a square U-shape. The legs of the staple driven out pierce a material to be stapled (not shown) on the stapling stand 47, and are clinched by the clincher section 48 to complete the stapling operation. The staple sheet "a" is sequentially formed and driven out by repeating the above operation. Since the above operation is the same as that disclosed in Japanese Unexamined Utility Model Publication No. Hei. 4-54683 and the like, no detailed description thereof will be herein given.

When a staple is jammed by buckling or the like during the stapling operation, the cartridge 1 is taken out of the electric stapler main body 2, and the L-shaped engaging piece 21 of the cartridge main body 1*a* is released from the face plate 32, so that the face plate 32 is caused to pivot about the shaft member 25 by the force of the tension spring 37. As a result, the pusher 29 and the staple passage 27 are exposed, thereby allowing the jammed staple to be removed.

Figure 4:
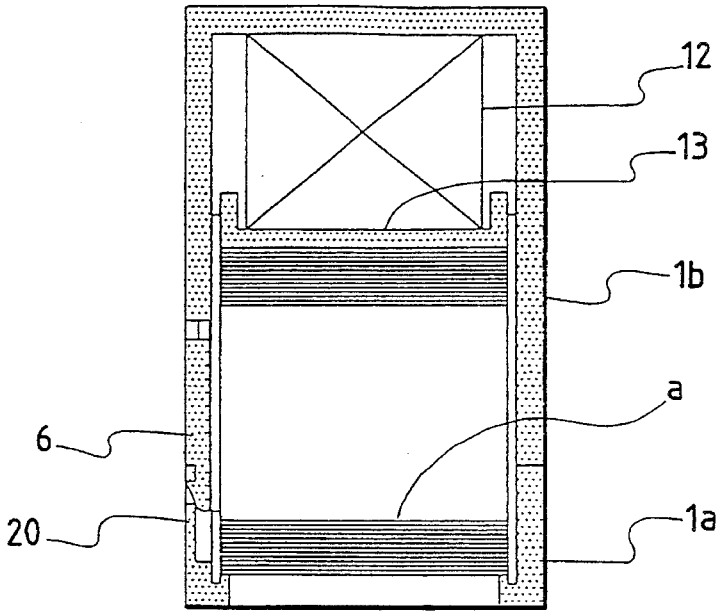
FIG. 4 is a sectional view taken along a line X—X of FIG. 3(*a*)
Figure 8:
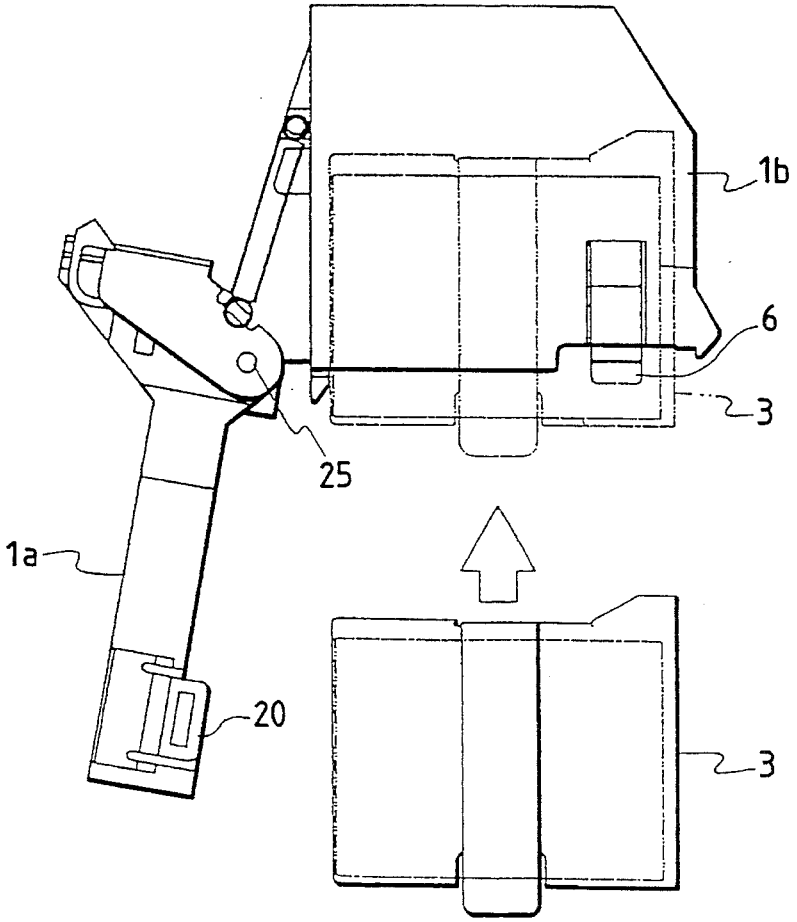
FIG. 8 is a diagram for explaining how the inner cartridge is replaced.

If all the staple sheets "a" have been consumed and new staple sheets "a" must be replenished, then the cartridge 1 is taken out of the electric stapler main body 2; the retainment of the retaining pawls 6 with the engaging pieces 20 is released by pushing the retaining pieces 6 of FIG. 4 to thereby open the cartridge 1 as shown in FIG. 8; a new staple sheet case 3 is accommodated within the accommodating body 1*b*; and the cartridge 1 is then closed.

The sheet feed roller 43 may be incorporated into the cartridge 1.

Figure 9:
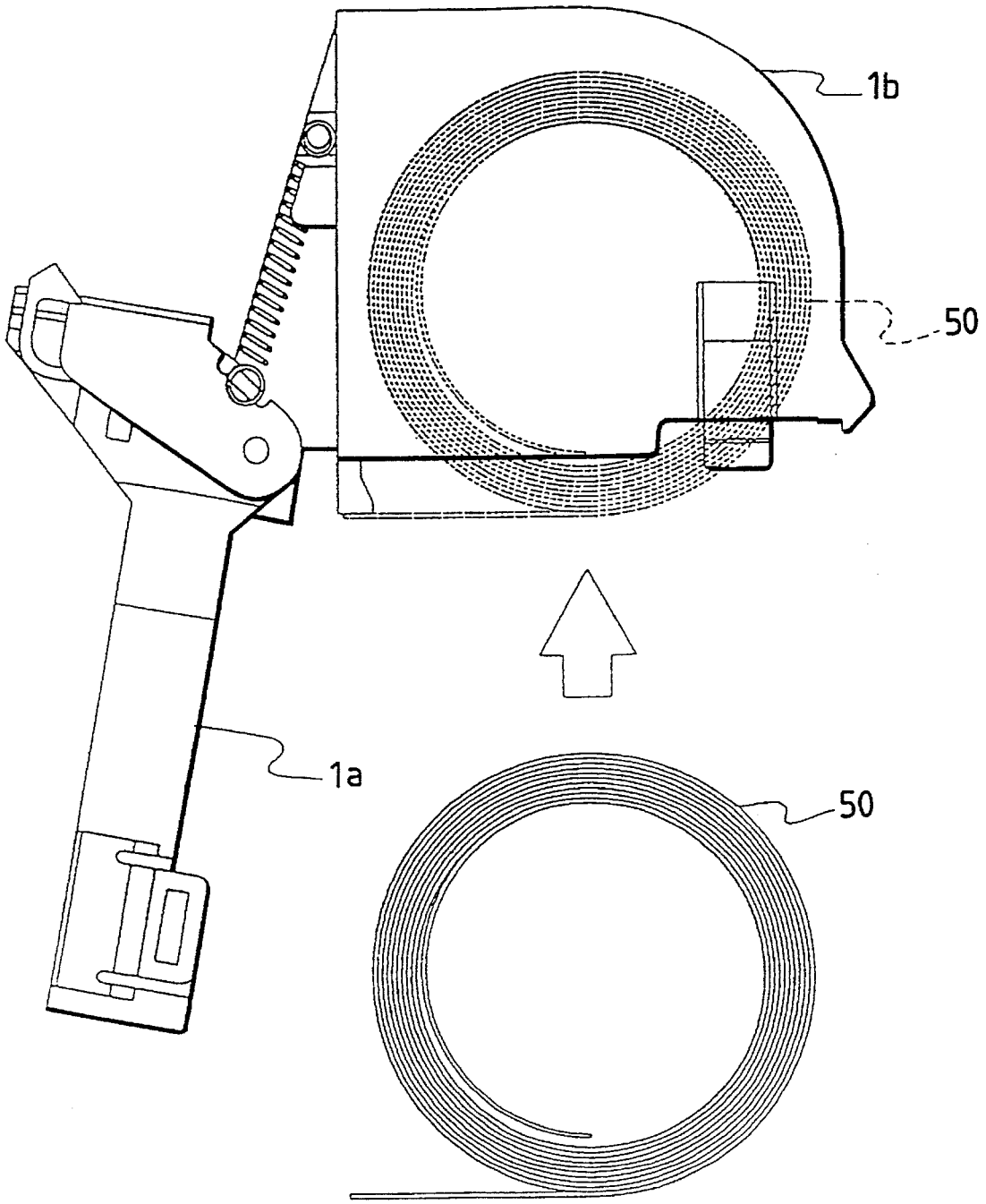
FIG. 9 is a diagram for explaining the case where a rolled sheet is used in place of a staple sheet.

It is not limited to the staple sheets that are attached to the cartridge 1. A rolled sheet 50 such as shown in FIG. 9 may be attached thereto.

What is claimed is:

1. An electric stapler comprising:

a cartridge; and an electric stapler main body on which said cartridge is detachably mounted, said cartridge integrally including:

an accommodating section for accommodating a plurality of staple sheets in multi-layered form, each of the staple sheets being formed by sticking straight staples together in sheet-like form;

a staple passage extending from a lower end of the accommodating section;

a pusher for pushing legs of a staple forward, said staple being formed into a square U-shape at a front end of said staple passage; and a drive channel, arranged at the front of said staple passage, for receiving the formed staple pushed by said pusher, the electric stapler main body including:

an attaching section for attaching the cartridge thereto;

a staple feeder for feeding the staple sheets from within said cartridge toward said staple passage;

a forming and driving device for sequentially forming a staple of the fed staple sheet from the front end of the staple sheet into a square U-shape and driving the formed staple out; and a clincher section for clinching the legs of the driven staple.

2. An electric stapler comprising:

a cartridge; and an electric stapler main body on which said cartridge is detachably mounted, said cartridge integrally including:

an accommodating section for accommodating a rolled sheet, the rolled sheet being formed by sticking straight staples together in rolled form;

a staple passage extending from a lower end of the accommodating section;

a pusher for pushing legs of a staple forward, said staple being formed into a square U-shape at a front end of said staple passage; and a drive channel, arranged at the front of said staple passage, for receiving the formed staple pushed by said pusher;

the electric stapler main body including:

an attaching section for attaching the cartridge thereto;

a staple feeder for feeding the staple sheets from within said cartridge toward said staple passage;

a forming and driving device for sequentially forming a staple of the fed staple sheet from the front end of the staple sheet into a square U-shape and driving the formed staple out; and a clincher section for clinching the legs of the driven staple.

* * * * *